United States Patent [19]

Henderson

[11] 4,245,800

[45] Jan. 20, 1981

[54] SPATIAL CODING OF LASER BEAMS BY OPTICALLY BIASING ELECTRO-OPTIC MODULATORS

[75] Inventor: David M. Henderson, Playa Del Rey, Calif.

[73] Assignee: Hughes Aircraft Company, Culver City, Calif.

[21] Appl. No.: 917,818

[22] Filed: Jun. 22, 1978

[51] Int. Cl.[2] ..... F41G 7/00

[52] U.S. Cl. ..... 244/3.13

[58] Field of Search ..... 244/3.13, 3.16

[56] References Cited

U.S. PATENT DOCUMENTS

| | | | |
|---|---|---|---|
| 3,398,918 | 8/1968 | Girault | 244/3.13 |
| 3,746,280 | 7/1973 | Coxe et al. | 244/3.13 |
| 4,014,482 | 3/1977 | Esker et al. | 244/3.13 |
| 4,030,686 | 6/1977 | Buchman | 244/3.13 |

*Primary Examiner*—Charles T. Jordan

*Attorney, Agent, or Firm*—Kenneth W. Float; W. H. MacAllister

[57] ABSTRACT

Apparatus for encoding a laser beam with information indicative of position in the beam. A linearly polarized laser beam passes through a birefringent wedge which encodes a continuously varying polarization across one dimension thereof. The polarization-encoded laser beam is applied to an electro-optic modulator which induces a second harmonic component of an applied modulation signal to appear in the beam due to optical biasing by the polarization encoding. On beam center, only the fundamental appears, while going away from beam center the second harmonic appears, having a varying magnitude and phase. A polarizer transmits a linearly polarized component of the encoded beam. To encode a second dimension of the beam orthogonal to the first, a second wedge and modulator are provided. To provide discrimination between the two, the second modulator operates at a different fundamental modulation frequency. The doubly-encoded beam is applied to a polarizer which transmits a linearly polarized component of the laser beam. A receiver detects and separates the encoded signals by frequency, and the fundamental signals are frequency-doubled and compared with the second harmonic signals. A signal is developed which is a function of the magnitude and phase of the second harmonic of each encoded dimension. These signals are indicative of the receiver position in the beam, and may be used as error signals, as in a missile guidance system or the like.

13 Claims, 8 Drawing Figures

SPATIAL CODING OF LASER BEAMS BY OPTICALLY BIASING ELECTRO-OPTIC MODULATORS

BACKGROUND OF THE INVENTION

This invention relates generally to laser guidance systems and, more particularly, to systems which spatially encode a laser beam with position information.

One application of this invention is in the field of missile guidance systems which operate to cause a missile to fly down the center of a transmitted beam, such as a beam-rider guided missile. The advent of the laser has provided a very accurate transmission means for use in these guidance systems.

A typical guidance system incorporates a laser transmitter located at the missile launch point and a receiver located on the missile. The receiver decodes information transmitted by the laser which provides guidance signals to the missile navigation system.

Numerous methods for coding a laser beam have been developed. These include opto-mechanical, electro-optic, acousto-optic and Stark effect modulation. The present invention utilizes an improvement upon, and simplification of, an electro-optic modulation system to produce guidance and control signals.

One prior electro-optic modulation system is described in U.S. Pat. No. 4,030,686. Therein, a laser beam is transmitted through a birefringent wedge positioned to encode the beam in one dimension with a continuum of polarization states varying from left-handed circularly polarized at one edge of the beam, to linearly polarized at beam center, to right-handed circularly polarized at the opposite edge of the beam. This means that, relative to the phase of a particular component of the light beam, if that component has no relative phase shift at beam center, then the phase will be $-90°$ at one edge of the beam and $+90°$ at the other edge.

This polarized beam is then transmitted in a first laser pulse to a receiver where it impinges upon a polarization sensitive beam splitter which diverts the horizontal component of the energy to one detector and the vertical component to a second detector. This provides one dimensional (i.e., azimuth) information to the receiver. To obtain a second dimension (elevation), it is necessary to mechanically rotate the birefringent wedge into a second position and transmit a second laser pulse, which is again decoded by the beamsplitter and detectors.

There are inherent problems associated with a system such as the one described above. Signal levels received by the detectors change by a factor of 120 db during a typical flight. This implies the need for automatic gain control (AGC) in the receiver. However, with two detectors in separate channels, to incorporate AGC the channels must be identically balanced, which is a very difficult problem.

Thus it is an object of this invention to provide an improved missile guidance system which is insensitive to transmitter-receiver range.

A further object is to provide a receiver which is simple in design, requiring only one detector, having AGC and stability mechanisms.

Another object of this invention is to provide an improved system for determining the position of remotely located objects.

Yet another object is to provide a system for determining the position of a remotely located body such that the position along at least one dimension can be determined from a single transmitted beam.

A still further object of the invention is to provide an improved position determining system which is adaptable for use in optical beam-rider guidance systems.

SUMMARY OF THE INVENTION

In accordance with the invention, the transmitter-receiver combination is an improved system for guiding a missile down the center of a transmitted laser beam, or more particularly, a system which transmits and detects position information encoded onto a laser beam for guidance purposes, or the like.

The system comprises both a transmitter and receiver. The transmitter includes a laser, which transmits a beam on which is initially encoded polarization information by means of a birefringent wedge as a function of position along one dimension of the beam. The polarized energy is then modulated at a fundamental frequency. The polarization induces a second harmonic component of the fundamental to appear at the output of the modulator which is a function of the position in the beam. A polarizer then selects a particular polarization component of the beam (i.e., horizontal) to finally transmit to the receiver.

The receiver focuses and detects the incoming energy by means of a single detector whose output is preamplified and filtered to obtain the fundamental and second harmonic frequency signals. Both signals are amplified and the fundamental is frequency doubled. The frequency doubled fundamental and second harmonic signals are mixed and the dc output provides a correction or error signal for the guidance electronics of a missile, for example.

The signals transmitted and decoded provide information as to only one dimension across the beam (i.e., horizontal). To obtain a signal indicative of the vertical position in the beam a second wedge, a second modulator and a second polarizer operating at a second fundamental frequency located in series with the first modulator are provided. As a result, position information is available for any point in the transmitted beam. Separate filters and amplifiers in the receiver section are provided that are tuned to the second fundamental and its second harmonic.

The second embodiment is a parallel-type system, utilizing a single laser feeding two encoding channels which separately encode two dimensions of the beam.

BRIEF DESCRIPTION OF THE DRAWINGS

The novel features of this invention, as well as the invention itself, will be better understood from the following description taken in connection with the accompanying drawings, in which like reference characters refer to like parts, and in which.

DETAILED DESCRIPTION OF THE INVENTION

Figure 1:
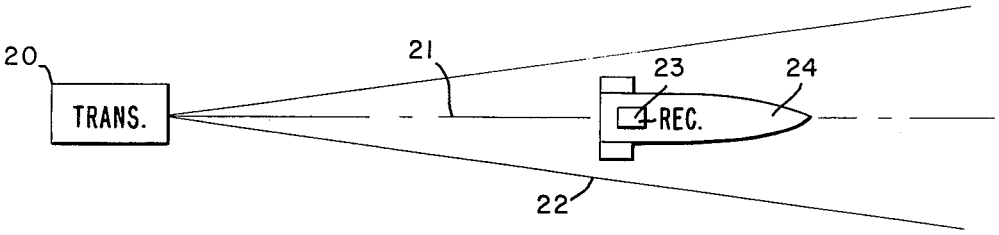
FIG. 1 is a diagram of a missile guidance system.

Referring now to FIG. 1 of the drawings, there is shown a missile guidance system in which a laser transmitter 20 emits a beam 22, encoded with directional information, which is received by a receiver 23 located on a missile 24. Error signals decoded by the receiver 23 enable the missile 24 to fly along the laser line-of-sight 21.

Figure 2:
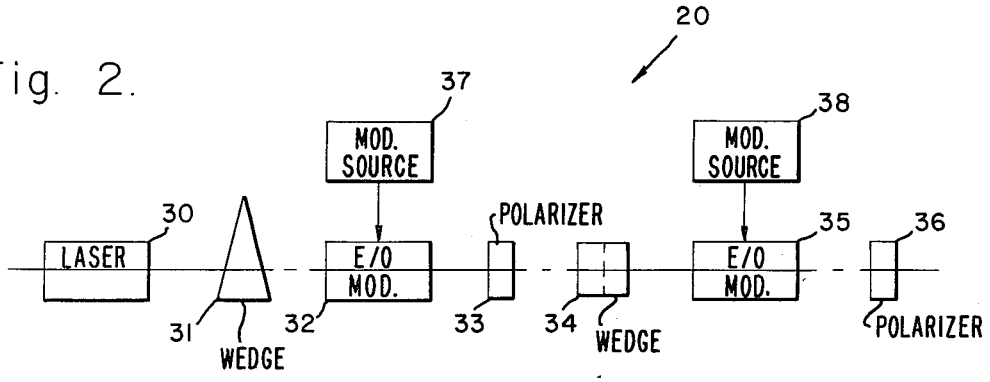
FIG. 2 is a diagram of the transmitter of the present invention.

According to one embodiment of the present invention shown in FIG. 2, a laser transmitter 20 suitable for use in the missile guidance system of FIG. 1 includes a laser 30, a first birefringent wedge 31, a first electro-optic modulator 32, a first polarizer 33, a second birefringent wedge 34, a second electro-optic modulator 35 and a second polarizer 36. These elements are optically aligned along a common axis.

Also shown are two modulation sources 37, 38 which apply modulation signals to respective first and second electro-optic modulators 32, 35. Appropriate electrical connections are provided on the modulation sources 37, 38 and modulators 32, 35.

The laser 30 emits a linearly polarized continuous wave (C.W.) laser beam and may be a gas or crystal laser, such as a $CO_2$ or ruby laser.

The first birefringent wedge 31, also known as a wedged wave plate which may be made of quartz, cadmium sulfide, or the like, receives linearly polarized laser energy emitted from the laser 30, and incident upon the input face of the first wedge 31. The first birefringent wedge 31 is constructed to have "fast" and "slow" optical axes. As a consequence of these "fast" and "slow" optical axes and the wedge angle and laser beam height, an incident linearly polarized laser beam is transformed such that it has a continuously varying polarization across one dimension of the beam. The first birefringent wedge 31 thus spatially encodes a laser beam as a function of polarization.

This encoding is done in a generally well-known manner, as described in U.S. Pat. No. 4,030,686, issued June 21, 1977, to W. W. Buchman for "Positioning Determining Systems", and assigned to the assignee of the present invention.

The first electro-optic modulator 32 is disposed to accept spatially encoded laser energy from the first birefrigent wedge 31. The first electro-optic modulator 32 is of the type which can be optically biased by means of the polarized energy incident upon its input.

The first modulator 32 is comprised of a material having electro-optic properties, such as cadmium telluride, or the like such as manufactured by II–VI Incorporated, Series OEM3, or the like. Electrically biasing the first modulator 32 normal to its optical axes produces asymmetry in the crystal lattice. This asymmetry can be likened to induced optical axes, normally termed "fast" and "slow" axes, similar to those of the first birefrigent wedge 31.

The first electro-optic modulator 32 is amplitude modulated by conventional means such as a first modulation source 37. The first modulation source 37 is of the type which applies a fundamental modulation frequency to the first modulator 32.

The first polarizer 33 is so disposed as to receive modulated laser energy and transmit a single polarization component thereof.

The second birefringent wedge 34, second electro-optic modulator 35, and a second polarizer 36 are disposed along the optical axis to encode a second dimension of the laser beam. The second birefringent wedge 34 and second electro-optic modulator 35 are rotated 90 degrees about the optical axis. Coupled with the second modulation source 38, the second set of elements function substantially the same as the first set of encoding elements described previously.

Figure 3:
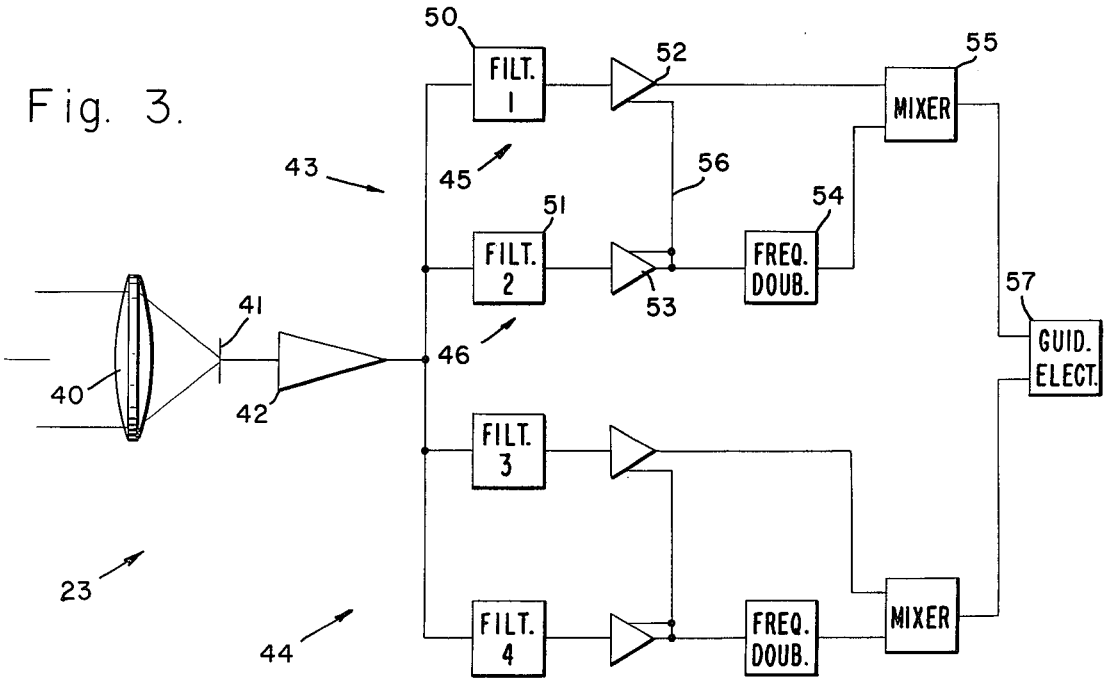
FIG. 3 is a diagram of a receiver for use with the transmitter of the present invention.

FIG. 3 shows a receiver 23 suitable for use in the missile guidance system of FIG. 1. Error signals proportional to the magnitude and phase of the second harmonic signals associated with the fundamental modulation frequencies of the electro-optic modulators 32, 35 are generated by the receiver 23. These signals correct the missile flight path so as to maintain the least amount of detected second harmonic signal, which causes the missile 24 to fly down the center of the beam 22.

Referring again to FIG. 3, there is shown an electronic circuit for determining the location of the receiver 23 in the beam 22 and generating error signals to be applied to associated guidance circuitry.

Therein is shown a lens 40, a detector 41, a preamplifier 42 and two processing circuits 43, 44. Both circuits 43, 44 are substantially the same, so only circuit 43 will be described.

The processing circuit 43 is comprised of two separate channels 45, 46, in which the first channel 45 includes a tuned frequency filter 50 and an amplifier 52, while the second channel 46 includes a tuned frequency filter 51, amplifier 53 and a frequency double 54. A feedback loop 56 couples the output of the second channel amplifier 53 back to the inputs of both amplifiers 52, 53 so as to maintain stability and automatic gain control (AGC). A mixer 55 is disposed so as to receive the output signals from the two channels 45, 46, and provide an appropriate error signal to the guidance electronics 57.

The lens 40, which may be made of quartz, germanium, or the like, is disposed so as to receive the encoded laser beam energy and focus the beam 22 onto the detector 41.

The detector 41, which may be mercury cadmium telluride, or the like, transforms optical energy into electrical signals. The output of the detector 41 is coupled to the input of the preamplifier 42, which is electrically compatible with the detector 41.

Referring primarily to the first processing circuit 43, the output of the preamplifier 42 is coupled to the inputs of two tuned frequency filters 50, 51. These filters 50, 51 distinguish the fundamental and second harmonic modulation signals transmitted by means of the encoded laser beam 22.

Referring specifically to the first channel 45 of the first processing circuit 43, the tuned filter 50 distinguishes the second harmonic signal of the fundamental frequency of the first modulator 32 and applies this signal to the amplifier 52 whose output is applied to the mixer 55.

Referring now to the second channel 46 of the first processing circuit 43, the tuned filter 51 distinguishes the fundamental frequency of the first modulator 32 and applies this signal to the amplifier 53. The amplified output of the amplifier 52 is applied to a frequency doubler 54 which doubles the frequency of the fundamental signal while keeping the amplitude of this signal the same. This frequency doubled fundamental signal is then applied to the mixer 55.

The mixer 55 receives the second harmonic signal from the first channel 45, and the frequency-doubled fundamental signal from the second channel 46 and mixes the two together in a conventional manner. The output of the mixer 55 is applied to the missile guidance circuitry 57.

The second processing circuit 44 operates substantially the same as the first processing circuit 43. Therein the similar circuitry of this processing circuit 44 operates upon the fundamental and second harmonic signals generated by the second modulator 35 of the transmitter 20 and applies the mixed output to the missile guidance circuitry 57.

In operation, a linearly polarized laser beam emitted by the laser 30 is first encoded such that the polarization of the energy varies across the beam. As mentioned previously, this encoding is done in a generally well-known manner, as described in U.S. Pat. No. 4,030,686. The linearly polarized beam is incident upon the first birefrigent wedge 31 which has its optical axes oriented at 45° with respect to the polarization of the incident beam. The first birefringent wedge 31 converts the incident linearly polarized laser energy into polarized energy of varying ellipticity across the beam.

On beam center the exiting energy is circularly polarized (i.e., 0° phase shift with respect to the incident energy), and at the beam edges the energy is elliptically polarized but has a phase shift of +90° at one edge and −90° at the other edge.

As a consequence of the effect of the first birefringent wedge 31, the existing laser energy is separated so as to have a continuously varying polarization across the beam, and thus the beam is spatially encoded.

This polarized energy is incident upon a first electro-optic modulator 32, which is an electro-optic crystal to which a voltage $V_m$ is applied normal to the direction of propagation of the polarized energy. This is accomplished by means of two electrodes placed along two opposing lateral faces of the crystal and forming a capacitor-like situation. An electrical field is applied to the electrodes from the first modulation source 37. The applied voltage induces asymmetry within the crystal which can be likened to induced optical axes. These induced optical axes are oriented or positioned parallel to those of the first birefringent wedge 31 for the crystal orientation used. The applied voltage $V_m$ has associated with it a fundamental frequency $\omega_m$ which modulates the polarized energy as it propagates through the crystal.

The first electro-optic modulator 32 also introduces a phase shift or retardation which is proportional to the product of the applied field $V_m$ times the crystal length, which is additive with the phase shifts of the first birefringent wedge 31, the laser 30 and the first polarizer 33, and so on.

The phase shift introduced by the first birefringent wedge 31 induces, in general, a second harmonic component of the fundamental modulation frequency $\omega_m$ to appear at the output of the first modulator 32. The magnitude of this second harmonic component is dependent upon the polarization at any point in the incident beam. On beam center, no second harmonic component exists, while increasing signals of opposite phase are present when proceeding to opposite edges of the beam.

Essentially, the static phase shift introduced by the birefringent wedge 31 leads to a signal at the second harmonic of the fundamental modulation frequency. On beam center the fundamental frequency is detected alone, no second harmonic exists. Going away frm beam center in the direction of the wedge 31, the second harmonic appears. The phase of the signal in reference to the fundamental changes by 180° from one side of the beam to the other. Thus the one dimensional location of the receiver in the beam can be determined from the magnitude and phase of the second harmonic.

Figure 4:
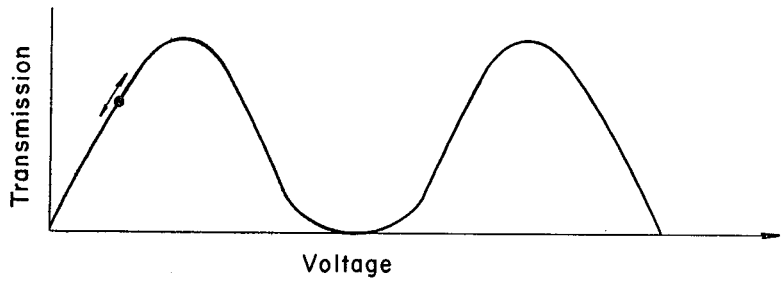
FIG. 4 is a plot of transmission versus voltage for certain elements of the present invention.

A further understanding of the electro-optic modulation process may be obtained by referring to FIG. 4. Therein is shown a graph representing the output at the first polarizer 33 with respect to an applied bias voltage (i.e., transmission versus voltage curve) but is applicable as well to the optical bias supplied by the birefringent wedge.

The curve shown is the basic transmission of the system of FIG. 2 due to the spatial encoding created by the first birefringent wedge 31. At any particular point on this curve, which may be called an optical bias point, the modulation of the first electro-optic modulator 32 causes the transmission to move up and down along this curve about the original bias point as indicated by the arrows, thus producing a signal at the fundamental modulation frequency. In addition, a second harmonic component can be generated.

The modulated beam is then transmitted through a first polarizer 33 which transmits or passes a single component of the polarized beam.

Thus, the first birefringent wedge 31, the first electro-optic modulator 32 and the first polarizer 33 spatially encode the laser beam with position information in terms of frequency across one dimension of the beam.

Similarly, position information across a second dimension of the beam (usually chosen at 90° to the first direction, i.e., orthogonal) is generated by using a second birefringent wedge 34 and second electro-optic modulator 35 rotated 90° relative to the orientation of the first birefringent wedge 31 and first modulator 32. The second wedge 34 and second modulator 35 operate identically to the first devices 31, 32, however, for discrimination purposes the second modulator 35 is operated at a fundamental frequency different from that of the first electro-optical modulator 32.

Finally, a second polarizer is positioned to transmit a single polarization component of the encoded laser beam. The transmitted laser beam has position information thus encoded in two orthogonal directions across the beam. Information from each direction is a function of a particular modulation frequency and its associated second harmonic.

Viewed in its mathematical terms, neglecting power loss, the power transmitted by the elements (31, 32 and 33) can be expressed as $P=P_o\sin^2(\Gamma/2)$, where $\Gamma$ is the optical phase shift (or retardation) encountered in the elements (31, 32 and 33) and $P_o$ is the power for laser 30.

For a linear birefringent wedge which changes by a quarter wave over a distance a, and for modulation at frequency $\omega_m$, $$\Gamma = \frac{\pi}{2}\left(1 + \frac{X}{a}\right) + \Gamma_m \sin(\omega_m t)$$

where $$\Gamma_m = \frac{\pi V_m l/d}{V_o}$$

where

X = spatial coordinate
$V_m$ = modulator voltage
l = modulator length
d = electrode separation $V_o$=constant dependent upon modulator material
t=time The first term represents the phase shift for the birefringent wedge 31 while the second is the phase shift for the electro-optic modulator 32.

Upon detection, the current $i(\omega)$ generated at the modulation frequency $f_m$ is proportional to the optical power at that frequency. Consequently, $$i(\omega_m) \propto P_o(X) \cos(\pi x/2a) \cdot J_1(\Gamma_m) \sin(\omega_m t)$$

and at the second harmonic, $$i(2\omega_m) \propto P_o(X) \sin(\pi X/2a) \cdot J_2(\Gamma_m) \cos(2\omega_m t)$$

where $J_1$ and $J_2$ are Bessel functions of the first and second kind, respectively.

The expressions representing the transmission of the second wedge 34, second modulator 35 and second polarizer 36 are substantially identical. The form of the equations is the same but the variables are, of course, those of the second set of elements, which encode the information primarily as a function of a second modulation frequency.

Error signals proportional to the magnitude and phase of the second harmonic of each fundamental modulation signal are generated by the receiver 23 shown in FIG. 3. These signals correct the flight path of the missile 24 so as to maintain the least amount of detected second harmonic, which causes the missile 24 to fly down the center of the beam 22.

The encoded laser light is focussed onto the detector 41 whose output signal is preamplified by the preamplifier 42. The first fundamental and associated second harmonic signals defined above are separated and distinguished by filters 50, 51. These signals are separately amplified by amplifiers 52, 53. The output of the fundamental amplifier 53 is fed back by the feedback loop 56 to both the fundamental and second harmonic amplifiers 52, 53 so as to provide for automatic gain control (AGC) and stability. This tends to balance both amplifier channels based on signal strength received at the fundamental frequency (thus compensating for dynamic variations in signal strength during missile flight, for example). The output of the fundamental amplifier 53 is then doubled in frequency by the frequency doubler 54. The magnitude of this signal is not changed during this step. Finally, the frequency-doubled fundamental signal and the second harmonic signal are mixed by the mixer 55 to provide the error signal. This signal is given by the mathematical expression $$V_{out} \propto [J_2(\Gamma_m)/J_1(\Gamma_m)] \tan(\pi X/2a)$$

which is the error signal. This signal is transmitted to the missile guidance circuitry 57.

The separate channel 44 for the second fundamental, and its second harmonic, processes these signals in the same manner as above. The circuitry is identical and is shown unnumbered in FIG. 3.

A typical transmitter 20 would use a $CO_2$ laser 30, cadmium sulfide birefringent wedges 31, 34, and cadmium telluride electro-optic modulators 32, 35. The modulators 32, 35 would be biased at 500 volts having applied fundamental modulation frequencies of 20 KHz and 25 KHz respectively for the first and second modulators 32, 35.

Figure 5:
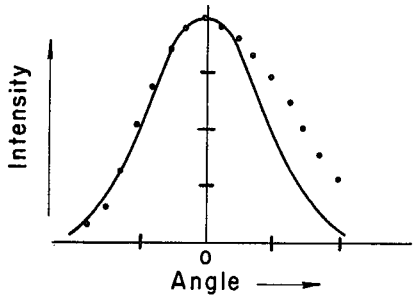
FIGS. 5, 6 and 7 are graphs of experimental data from tests run on a particular embodiment of the present invention.
Figure 6:
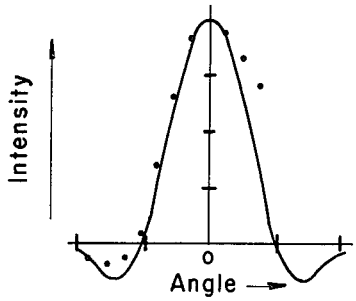
Figure 7:
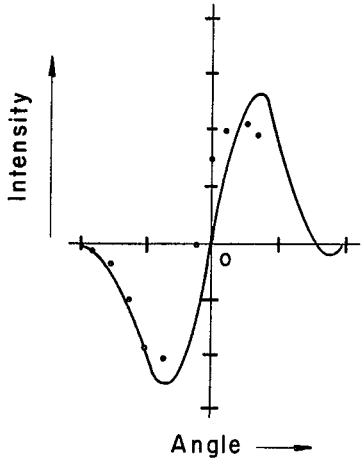

Apparatus utilizing these components has been actually operated, with results indicated in FIGS. 5, 6 and 7. The solid curves of FIGS. 5, 6 and 7 represent theoretical data, while the dotted curves represent actual test data. The signals detected on beam center at the fundamental frequency were at a maximum, while the second harmonic signal on beam center was essentially zero.

FIG. 5 shows the intensity profile of laser energy incident upon the detector 41, FIG. 6 shows the peaking of the fundamental frequency on beam center, and FIG. 7 shows the zero crossing of the second harmonic near beam center.

Figure 8:
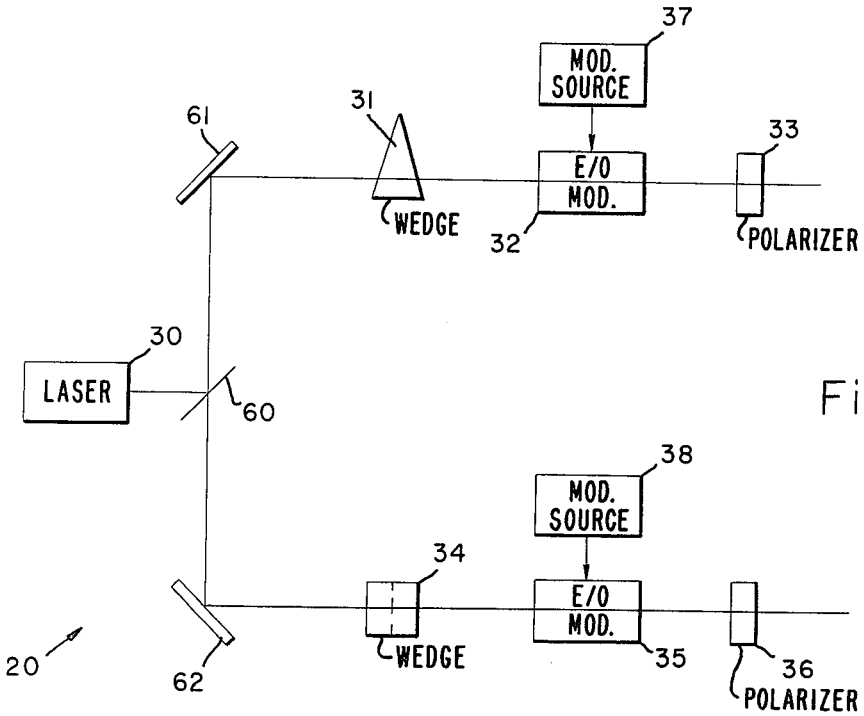
FIG. 8 is a diagram of a second embodiment of the present invention.

A second embodiment of the transmission system 20 is shown in FIG. 8. This transmitter is substantially the same as the embodiment of FIG. 2, but herein the components associated with the two encoding dimensions are arranged in parallel.

To accomplish this, a beamsplitter 60 and two mirrors 61, 62, or the like, are provided. Thus, the laser beam is separated, encoded by the two channels and transmitted to the receiver 23.

Although the present invention has been shown with reference to a beam-rider guided missile application, it should be readily apparent that there are other obvious uses of the present invention. Such applications would include apparatus to guide tunnel-drilling or construction equipment, or machinery that would grade or pave a straight road. Typically, any situation that calls for guiding an object along a straight line path would find use for the present invention.

Thus, there has been described a laser guidance system which is insensitive to transmitter-receiver separation and incorporates automatic gain control and stabilizing electronics. Inherent difficulties in previous systems have been overcome by the use of a single detector in the receiver, allowing for automatic gain control over a wide dynamic range.

The inherent characteristics of the transmitter components allow the system to utilize a higher power laser than prior art, thus increasing the range capability of the transmitter-receiver combination.

It is to be understood that the above-described embodiments of the invention are merely illustrative of the many possible specific embodiments which represent applications of the principles of the present invention. Numerous and varied other arrangements can readily be devised in accordance with these principles by those skilled in the art without departing from the spirit and scope of the invention.

What is claimed is:

1. An apparatus for spatially encoding a laser beam such that modulation components at a second harmonic of a predetermined frequency are indicative of position across at least one dimension of said beam, said apparatus comprising:

polarization encoding means for providing a laser beam encoded such that the polarization varies across at least one dimension of said beam;

a modulation source for providing a modulating signal at said predetermined frequency; and an electro-optic modulator, responsive to said modulating signal and disposed to receive the encoded output beam from said polarization encoding means;

whereby the laser beam at the output of said electro-optic modulator has modulation components induced thereon at said predetermined frequency and at the second harmonic thereof such that the relative amplitude and phase of said second harmonic modulation component is indicative of position across at least one dimension of said beam.

2. The apparatus of claim 1, wherein said polarization encoding means comprises:

laser means for producing a linearly polarized laser beam, and a birefringent widge disposed to receive said linearly polarized laser beam and configured so as to encode a continuously varying polarization across said at least one dimension of said beam.

3. Apparatus for spatially encoding a laser beam such that a signal component at the second harmonic of a modulating frequency is indicative of position across at least one dimension of said beam, said apparatus comprising:

laser means for producing a linearly polarized laser beam;

a birefringent wedge disposed to receive said linearly polarized laser beam and configured so as to encode a continuously varying polarization across said at least one dimension of said beam such that said polarization varies from elliptical of one rotational sense, through circular, to elliptical of the opposite rotational sense;

a source of modulating signals at a predetermined frequency; and an electro-optic modulator disposed to receive the polarization encoded beam from said birefringent wedge and responsive to said modulating signals;

whereby the laser beam at the output of said electro-optic modulator has modulation components induced thereon such that the relative amplitude and phase of the modulation component at the second harmonic of the frequency of the modulating signal, compared to the modulation component at the frequency of the modulating signal, is indicative of position across at least one dimension of said beam.

4. Apparatus for spatially encoding a laser beam, comprising:

laser means for providing a linearly polarized laser beam;

a birefringent wedge responsive to said linearly polarized laser beam for encoding one dimension of said beam, said encoding being a continuously varying polarization across said one dimension;

a modulation source for providing modulating signals of a predetermined frequency;

a modulator responsive to said encoded beam such that said encoding optically biases said modulator to induce onto said beam modulation components at the frequency of the modulating signal and at the second harmonic of the modulating signal; and a polarizer responsive to the output beam from said modulator for transmitting a linearly polarized component of said beam.

5. An apparatus for spatially encoding a laser beam such that modulation components at a second harmonic of a predetermined frequency are indicative of position across at least one dimension of said beam, said apparatus comprising:

laser means for providing a linearly polarized laser beam;

a birefringent wedge responsive to said linearly polarized laser beam for encoding one dimension of said beam, said encoding being a continuously varying polarization across said one dimension;

a modulation source for providing modulating signals at a predetermined frequency; and a modulator responsive to said modulating signals and to said continuously varying polarization transmitted by said birefringent wedge in such a manner that said continuously varying polarization optically biases said modulator to induce a second harmonic component of said predetermined frequency applied to said modulator by said modulation source to appear in said laser beam transmitted by said modulator;

whereby the laser beam at the output of said modulator has modulation components induced thereon at said predetermined frequency and at the second harmonic thereof such that the relative amplitude and phase of said second harmonic modulation components is indicative of position across at least one dimension of said beam.

6. Apparatus for spatially encoding a laser beam such that a second harmonic of a modulating frequency is indicative of position across at least one dimension of said beam, said apparatus comprising:

first polarization encoding means for encoding a continuously varying polarization across one dimension of said beam;

a first modulation source for providing modulating signals at a first predetermined frequency;

first modulation means, responsive to said modulating signals from said first modulation source, and disposed to receive the encoded output beam from said first polarization encoding means for inducing a second harmonic component of said first predetermined frequency thereon such that the relative amplitude and phase of said component is indicative of position across said at least one dimension of said beam;

second polarization encoding means for encoding a continuously varying polarization across a second dimension of said beam;

a second modulation source for providing modulating signals at a second predetermined frequency; and second modulating means, responsive to said modulating signals from said second modulation source, and disposed to receive the encoded output from said second polarization encoding means for inducing a second harmonic component of said second predetermined frequency thereof such that the relative amplitude and phase of said component is indicative of position across said second dimension of said beam.

7. Apparatus for spatially encoding a laser beam, comprising:

laser means for providing a linearly polarized laser beam;

a first birefringent wedge responsive to said linearly polarized laser beam for encoding one dimension of said beam, said encoding being a continuously varying polarization across said one dimension;

a first modulation source for providing modulating signals at a first predetermined frequency;

a first modulator responsive to said modulating signals of said first modulation source and to said continuously varying polarization encoded beam transmitted by said first birefringent wedge in such a manner that said continuously varying polarization optically biases said first modulator to induce a second harmonic component of said first predetermined frequency to appear in said laser beam transmitted by said first modulator;

a polarizer responsive to the output of said modulator for transmitting a linearly polarized component of said beam;

a second birefringent wedge disposed to receive said linearly polarized component of said beam from said polarizer, for encoding a second dimension across said beam, said encoding having a continuously varying polarization across said second dimension;

a second modulation source for providing modulating signals at a second predetermined frequency; and a second modulator responsive to said modulating signals of said second modulation source and to said continuously varying polarization encoded beam transmitted by said second birefringent wedge in such a manner that said continuously varying polarization optically biases said second modulator to induce a second harmonic component of said second predetermined frequency to appear in said laser beam transmitted by said second modulator.

8. Apparatus for spatially encoding a laser beam as a function of position across two dimensions, said apparatus comprising:

laser means for providing a linearly polarized laser beam;

means for dividing, said linearly polarized laser beam into two output beams;

a first channel coupled to receive one output beam and comprising first polarization encoding means for encoding a continuously varying polarization across a first dimension and first modulation means disposed to receive the encoded output from said first polarization encoding means for inducing a second harmonic component thereon such that the relative amplitude and phase of said component is indicative of positon across said first dimension; and a second channel coupled to receive the other output beam and comprising a second polarization encoding means for encoding a continuously varying polarization across a second different dimension and second modulation means disposed to receive the encoded output from said second polarization encoding means for inducing a second harmonic component thereon such that the relative amplitude and phase of said component is indicative of position across said second dimension.

9. A receiver adapted for decoding position information from a laser beam which is encoded to have modulation components at a preselected frequency and at a second harmonic thereof such that the relative amplitude and phase of the second harmonic component is indicative of position across at least one dimension of said beam, said receiver comprising:

a signal mixer;

means for detecting said laser beam and for providing signals at said preselected frequency and the second harmonic thereof;

means for doubling the frequency of said signal at said preselected frequency; and means for applying the signals provided by said means for doubling and said second harmonic signal to first and second input circuits respectively of said signal mixer;

whereby the output signal from said mixer is indicative of position across said laser beam.

10. Apparatus for receiving and processing a spatially encoded laser beam wherein said encoding is indicative of the position across one dimension of said beam, said encoding being dependent upon the amplitude and phase of modulation components at the second harmonic of a predetermined frequency compared to modulation components at the predetermined frequency, said apparatus comprising:

detection means for receiving said encoded laser beam and for transforming the optical signals thereof into electrical signals;

a mixer;

means for doubling the frequency of electrical signals at said predetermined frequency; and means for applying the output signal from said means for doubling and the second harmonic signal to respective input circuits of said mixer;

whereby the output signal from said mixer is indicative of the position of the received energy in the encoded beam.

11. A method of spatically encoding a laser beam by optically biasing an electro-optical modulator to which a fundamental modulating signal is applied, the steps of said method comprising:

polarizing a laser beam such that the polarization varies continuously across one dimension of said beam, so as to produce a polarization encoded beam; and applying the polarization encoded beam through said electro-optic modulator whereby the polarization optically biases said modulator such that a fundamental component and a second harmonic frequency component indicative of position across one dimension of said beam, are induced onto said beam.

12. A method for coding a laser beam with position-indicating information comprising the steps of:

first modulating a laser beam to have a continuously varying ellipticity across one dimension thereof; and then re-modulating said laser beam to change said continuously varying ellipticity to a continuously varying phase and amplitude of the second harmonic of a fundamental modulation frequency.

13. Apparatus for optically encoding a laser beam such that a signal component at a second harmonic of a modulating frequency is indicative of position across at least one dimension of said beam, said apparatus comprising:

a laser;

a birefringent wedge;

an electro-optic modulator;

said laser, said birefringent wedge, and said electro-optic modulator all being operatively alligned along a common optical axis; and a modulating signal source electrically connected to said modulator.

* * * * *

UNITED STATES PATENT AND TRADEMARK OFFICE

CERTIFICATE OF CORRECTION

PATENT NO. : 4,245,800

DATED : Jan. 20, 1981

INVENTOR(S) : David M. Henderson

It is certified that error appears in the above—identified patent and that said Letters Patent is hereby corrected as shown below:

IN THE CLAIMS:

Claim 11, column 12, line 27, delete the word "spatically" and substitute therefor --spatially--.

Signed and Sealed this

*Sixteenth* Day of *June 1981*

[SEAL]

*Attest:*

RENE D. TEGTMEYER

*Attesting Officer*

*Acting Commissioner of Patents and Trademarks*